US005490607A

United States Patent [19]

Hsieh et al.

[11] Patent Number: 5,490,607

[45] Date of Patent: Feb. 13, 1996

[54] KNIFE HOLDER

[76] Inventors: Wen-Hsiung Hsieh; Hu M. Wu, both of 58, Ma Yuan West St., Taichung, Taiwan

[21] Appl. No.: 360,011

[22] Filed: Dec. 19, 1994

[51] Int. Cl.[6] ..... A47F 1/04

[52] U.S. Cl. ..... 220/483; 220/232; 211/70.7; 206/372

[58] Field of Search ..... 720/480, 483, 720/697; 206/350, 372, 553; 211/70.7; 224/183, 191, 232, 904

[56] References Cited

U.S. PATENT DOCUMENTS

| | | | |
|---|---|---|---|
| 1,569,508 | 1/1926 | Lee | 224/232 X |
| 1,614,342 | 1/1927 | Bleckley | 211/70.7 X |
| 1,746,503 | 2/1930 | Timmons | 224/232 X |
| 1,876,284 | 9/1932 | Fried | 220/232 X |
| 2,214,869 | 9/1940 | West | 220/483 X |
| 2,459,391 | 1/1949 | Otis | 211/70.7 X |
| 2,955,789 | 10/1960 | Smith | 211/70.7 |
| 5,050,749 | 9/1991 | Scaglione | 211/70.7 |
| 5,405,004 | 4/1995 | Vest et al. | 206/372 X |

*Primary Examiner*—Steven M. Pollard

[57] ABSTRACT

A knife holder includes a board having a rib laterally formed on the front surface and having two cavities formed in the rear surface for receiving magnets which may attach the knife holder to metal surface. A case includes a rear panel and two flanges extended rearward from the rear panel for engaging with the front surface of the board. The rear panel and the rib form a slot for receiving and for protecting knife blade. The knife blades may be completely received and protected between the board and the case.

1 Claim, 4 Drawing Sheets

KNIFE HOLDER

BACKGROUND OF THE INVENTION

1. Field of the Invention

The present invention relates to a holder, and more particularly to a knife holder.

2. Description of the Prior Art

A typical knife holder is shown in FIG. 4 and comprises a body 60 having one or more key holes provided on the upper portion for hanging to supporting nails and having a slot 62 formed therein for engaging and for supporting knives 63, 64. However, the cutting blades of the knives 63, 64 are exposed and may hurt people, particularly the children, inadvertently.

The present invention has arisen to mitigate and/or obviate the afore-described disadvantages of the conventional knife holders.

SUMMARY OF THE INVENTION

The primary objective of the present invention is to provide a knife holder for safely holding knives.

In accordance with one aspect of the invention, there is provided a knife holder comprising a board including a front surface having a rib laterally formed thereon and a rear surface having at least one cavity formed therein, a magnet member engaged in the cavity for attaching the knife holder to metal surface, a case including a rear panel and flange means extended rearward from the rear panel for engaging with the front surface of the board, the rear panel and the rib forming a slot therebetween for receiving and for protecting knife blade, and means for securing the case to the board.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
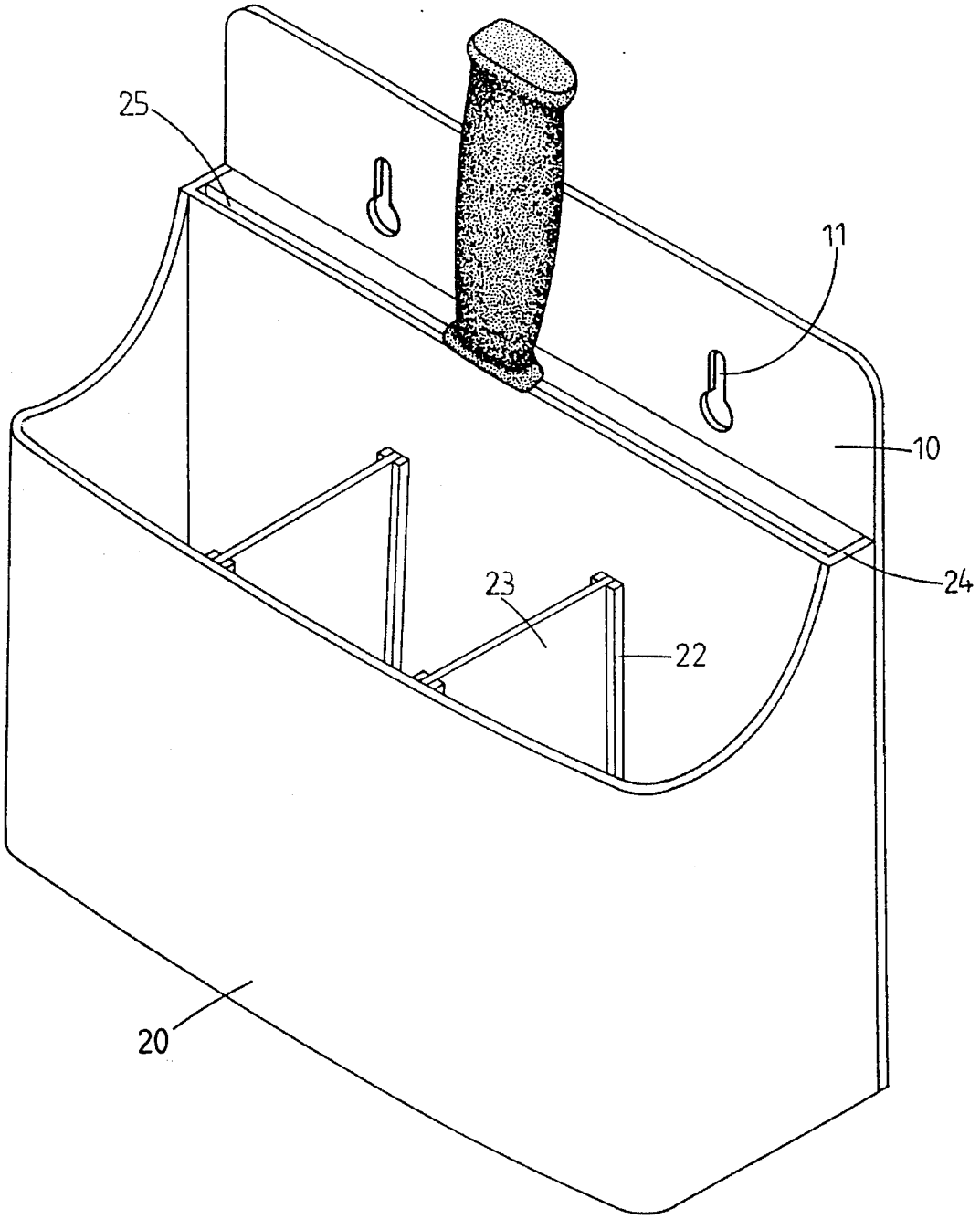
FIG. 1 is a perspective view of a knife holder in accordance with the present invention.
Figure 2:
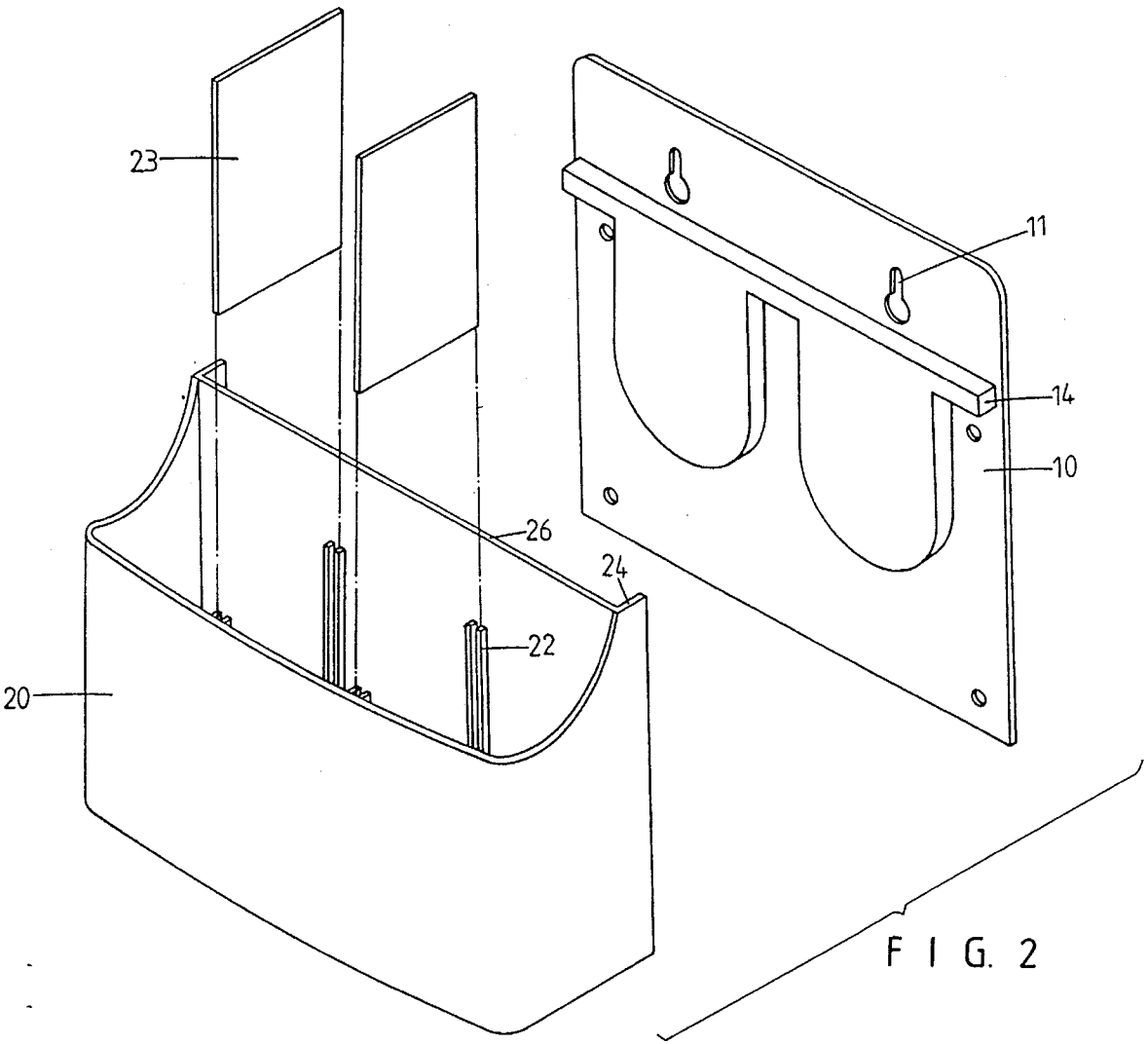
FIG. 2 is an exploded view as shown from the front portion of the knife holder.
Figure 3:
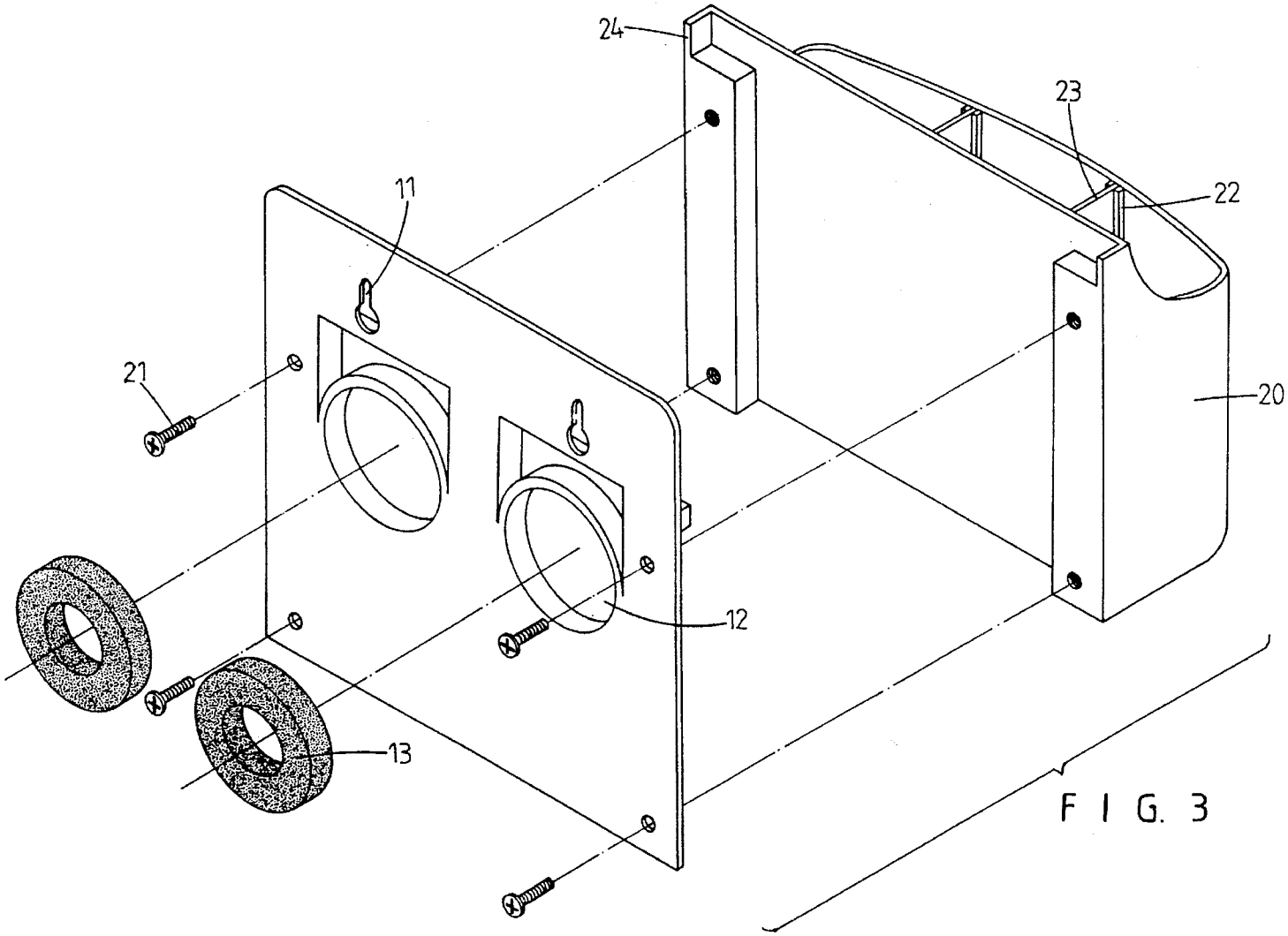
FIG. 3 is an exploded view as shown from the rear portion of the knife holder.
Figure 4:
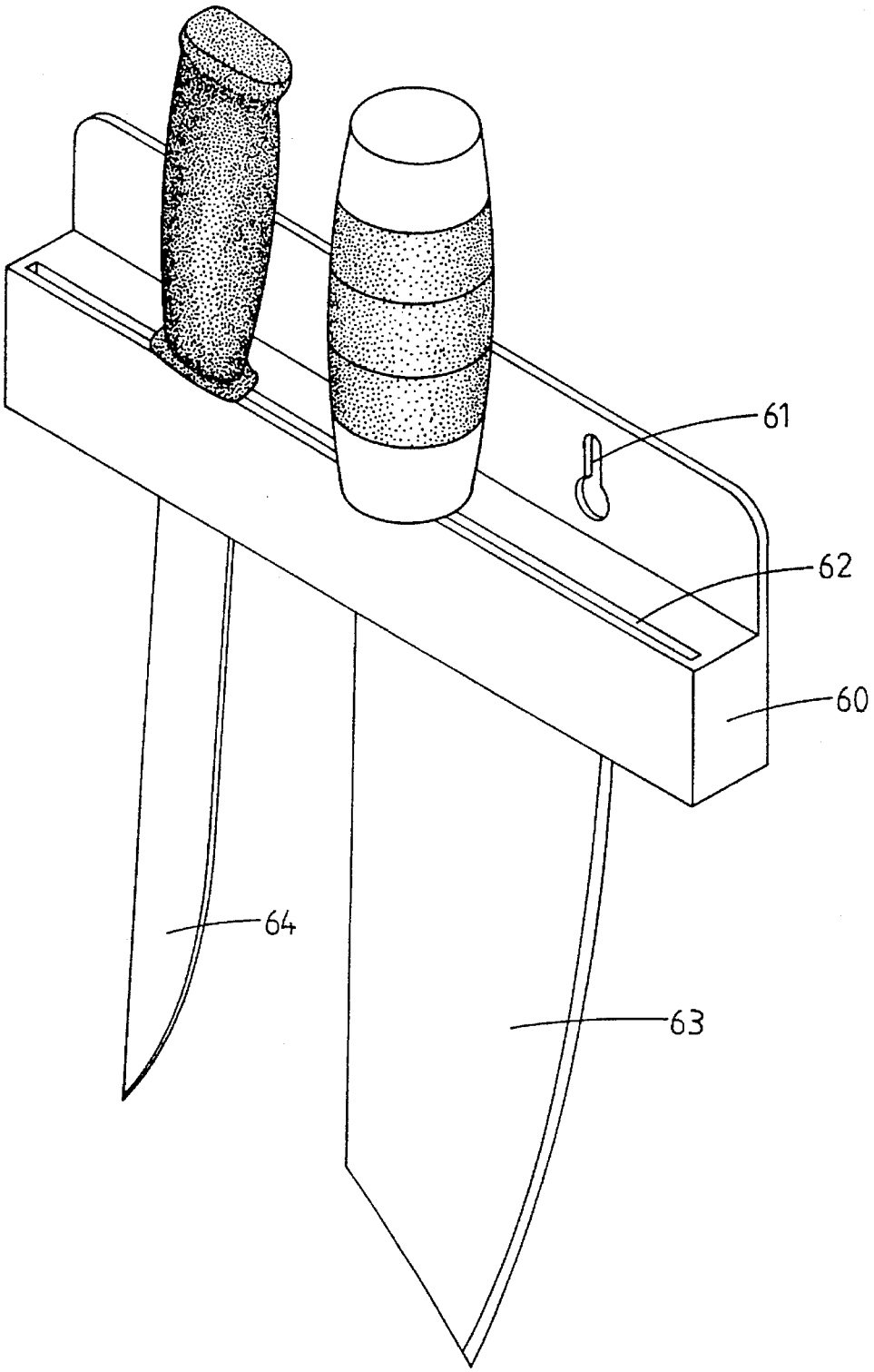
FIG. 4 PRIOR ART
FIG. 4 is a perspective view illustrating the typical knife holder.

Referring to FIGS. 1 to 3, a knife holder in accordance with the present invention comprises a board 10 including two key holes 11 formed in the upper portion for hanging to supporting nails and including two cavities 12 formed in the rear surface for engaging with two magnets 13 (FIG. 3), and including a rib 14 laterally formed in the upper portion of the front surface thereof. A case 20 is secured to the front surface of the board 10 by screws 21 and includes channel means 22 provided therein for engaging with partition plates 23 which separate the case 20 into a number of rooms for accommodating various kinds of objects. The case 20 includes a rear panel 26 having two flanges 24 extended rearward therefrom for engaging with the board 10. The flanges 24 includes a depth slightly larger than the thickness of the rib 14 such that a slot 25 is formed between the rib 14 and the rear panel 26 of the case 20 for receiving knives.

In operation, as shown in FIG. 1, the knife blade of the knife is completely received between the board 10 and the rear panel 26 of the case 20 and is safely protected by the same such that the knife blade can be prevented from hurting people. The knife holder may be hung on nails by the key holes 11 and may be attached to the metal surface with the magnets 13.

Accordingly, the knife holder in accordance with the present invention includes a configuration for safely holding knives.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A knife holder comprising:

a board including a front surface having a rib laterally formed thereon and a rear surface having at least one cavity formed therein, a magnet member engaged in said cavity for attaching said knife holder to metal surface, a case including a rear panel and flange means extended rearward from said rear panel for engaging with said front surface of said board, said rear panel and said rib forming a slot therebetween for receiving and for protecting knife blade, and means for securing said case to said board.

* * * * *